US006439384B2

(12) United States Patent
Martin

(10) Patent No.: US 6,439,384 B2
(45) Date of Patent: Aug. 27, 2002

(54) METHOD AND APPARATUS FOR WRAPPING, PROTECTING AND PREVENTING CORROSION ON COILED METAL

(75) Inventor: Janice M. Martin, Triadelphia, WV (US)

(73) Assignee: Liberty Distributers, Inc., Triadelphia, WV (US)

( * ) Notice: Subject to any disclaimer, the term of this patent is extended or adjusted under 35 U.S.C. 154(b) by 0 days.

(21) Appl. No.: 09/864,754

(22) Filed: May 24, 2001

Related U.S. Application Data

(60) Provisional application No. 60/212,325, filed on Jun. 16, 2000.

(51) Int. Cl.[7] ..... B65D 85/66; B65B 11/00

(52) U.S. Cl. ..... 206/397; 53/409; 53/461; 206/407; 206/410; 206/524.4

(58) Field of Search ..... 53/409, 461; 206/389, 206/396, 397, 407, 408, 410, 413–416, 524.1, 524.4

(56) References Cited

U.S. PATENT DOCUMENTS

| | | | | | |
|---|---|---|---|---|---|
| 3,856,141 | A | * | 12/1974 | Reed | 206/407 |
| 4,418,105 | A | | 11/1983 | Stratton | 428/40 |
| 4,513,864 | A | * | 4/1985 | Liebel | 206/396 |
| 4,524,562 | A | * | 6/1985 | Yagi et al. | 53/409 |
| 4,560,723 | A | | 12/1985 | Millet et al. | 524/486 |
| 4,844,973 | A | | 7/1989 | Konishi et al. | 428/286 |
| 4,928,454 | A | * | 5/1990 | Bertolotti | 53/409 |
| 4,995,512 | A | * | 2/1991 | Liebel | 206/396 |
| 5,139,700 | A | | 8/1992 | Miksic et al. | 252/389.54 |
| 5,236,087 | A | * | 8/1993 | Morgan | 206/397 |
| 5,372,865 | A | | 12/1994 | Arakawa et al. | 428/40 |
| 5,466,500 | A | | 11/1995 | Pluim | 428/40 |
| 5,599,602 | A | | 2/1997 | Leonard et al. | 428/56 |
| 5,657,613 | A | * | 8/1997 | Quinones | 53/409 |
| 5,715,945 | A | | 2/1998 | Chandler | 206/524.4 |
| 5,752,358 | A | * | 5/1998 | Chadwick | 53/111 R |
| 5,775,515 | A | * | 7/1998 | Chadwick | 206/416 |
| 5,782,058 | A | * | 7/1998 | Chadwick | 53/409 |
| 5,855,975 | A | | 1/1999 | Miksic et al. | 428/35.8 |
| 5,867,969 | A | * | 2/1999 | Quinones | 53/409 |
| 5,937,618 | A | | 8/1999 | Chandler | 53/427 |

* cited by examiner

*Primary Examiner*—Jim Foster
(74) *Attorney, Agent, or Firm*—Webb Ziesenheim Logsdon Orkin & Hanson, P.C.

(57) ABSTRACT

An apparatus and method for enclosing and protecting a metal coil in VPCI impregnated materials such that the metal coil can be transported in an eye horizontal orientation. The apparatus includes a metal coil that has an eye at its center and a vapor phase corrosion inhibitor (VPCI) impregnated material, which completely encloses an outer surface of the metal coil. A core extends along the length of the eye and has a first end and a second end. A first wing, having a collar that inserts into the first end of the core and wing members, is aligned next to the VPCI impregnated material. A second wing, having a collar that inserts into the second end of the core and wing members, is aligned next to the VPCI material.

25 Claims, 7 Drawing Sheets

METHOD AND APPARATUS FOR WRAPPING, PROTECTING AND PREVENTING CORROSION ON COILED METAL

CROSS-REFERENCE TO RELATED APPLICATION

This application claims priority from U.S. Provisional Patent Application Ser. No. 60/212,325, filed Jun. 16, 2000, and entitled "Method For Wrapping And Preventing Corrosion On Coiled Metal".

BACKGROUND OF THE INVENTION

1. Field of the Invention

The present invention relates to a method for protecting and preventing corrosion on the surface of metal coils during storage. More particularly, the present invention relates to a method and package employing vapor phase corrosion inhibitor impregnated materials for wrapping and storing metal coils in an eye horizontal position.

2. Background Art

In metal manufacturing it is common practice to form ingots of metal, which are subsequently rolled into long, relatively thin sheets. The sheets are typically then rolled into coils so that the long thin sheets of metal are easy to transport through the manufacturing facility and eventually to finished goods fabricating plants. The coils of metal have an opening in the middle, which is typically referred to as the "eye" of the coil.

The coils of metal can be transported in two different orientations. The coil can be turned on its side such that the eye is perpendicular to the floor. This is referred to as the "eye to the sky" orientation. In the eye to the sky orientation, the metal coil is typically placed on a pallet and moved from place to place with a forklift. The eye to the sky orientation is not always desirable for several reasons. First, when the metal coil is to be uncoiled for use, it must be set back on its side, such that it rests on the surface of the coil in what is termed the "eye horizontal" position. Secondly, the eye to the sky orientation does not make efficient use of space during transportation and storage. Lastly, moving the metal coils by forklift is not efficient in a manufacturing environment.

The eye horizontal metal coil orientation is often preferred because the metal coil can be transported through the manufacturing and fabricating environments using large overhead cranes, which traverse the plant on overhead rails. The overhead crane has a large hook, or "C" hook, which is placed through the eye of the metal coil. The crane is then able to lift the metal coil, move along the track and lower the metal coil at its next desired location.

A problem encountered with metal coils which are exposed to the environment is corrosion. Corrosion degrades the quality and color of the metal. One method used to prevent corrosion is to wrap the metal coil in a plastic film which contains a vapor phase corrosion inhibitor (VPCI) material. U.S. Pat. No. 5,139,700 to Miksic et al. describes commonly used VPCI materials and is incorporated herein by reference. The metal coil is wrapped or enclosed in the VPCI impregnated plastic film such that the air enclosed in and around the metal coil is isolated from the outside of the plastic wrap enclosure. The VPCI then saturates the enclosed air and forms a layer on the surface of the metal coil. This layer prevents corrosion on the surface of the metal. Methods of enclosing metals and metal components as described above are disclosed in U.S. Pat. No. 5,937,618 to Chandler; U.S. Pat. No. 5,855,975 to Miksic et al.; and U.S. Pat. No. 5,715,945 to Chandler, all of which are incorporated herein by reference.

A significant shortcoming of the above-described wrapping and enclosure methods for protecting metal coils is that the metal coil can only be transported in the less desired eye to the sky orientation. This is because, in the eye horizontal orientation, the use of a C hook would puncture the plastic wrapping or enclosure, allowing the VPCI to escape to the atmosphere and allowing moisture to come in contact with the metal coil, eventually leading to corrosion.

Thus, there is an established need to provide a means to wrap or encase metal coils to prevent corrosion such that the metal coils may be transported in the eye horizontal orientation.

SUMMARY OF THE INVENTION

The present invention relates to an apparatus and method for enclosing and protecting a metal coil in VPCI impregnated materials such that they can be transported in an eye horizontal orientation.

The apparatus for protecting coiled metal of the present invention includes a metal coil that has an eye at its center and a vapor phase corrosion inhibitor (VPCI) impregnated material, which completely encloses an outer surface of the metal coil. A core extends along the length of the eye and has a first end and a second end. A first wing, having a collar that inserts into the first end of the core and wing members, is aligned next to the VPCI impregnated material. A second wing, having a collar that inserts into the second end of the core and wing members, is aligned next to the VPCI material.

The method for protecting coiled metal of the present invention is applied to a metal coil which has an eye, an inner surface, a first side, a second side and an outer surface. In the method, the metal coil is wrapped with a vapor phase corrosion inhibitor (VPCI) impregnated material such that the outer surface, first side and second side of the metal coil are encased by the VPCI impregnated material. A core having a first end, a second end, an inner surface and an outer surface is inserted into the eye of the metal coil. A collar of a first wing is placed within the first end and against the inner surface of the core, and wing members of the first wing are placed against the VPCI impregnated material. A collar of a second wing is placed within the second end of the core and against the inner surface of the core, and wing members of the second wing are placed against the VPCI impregnated material.

DETAILED DESCRIPTION OF THE PREFERRED EMBODIMENTS

Figure 1:
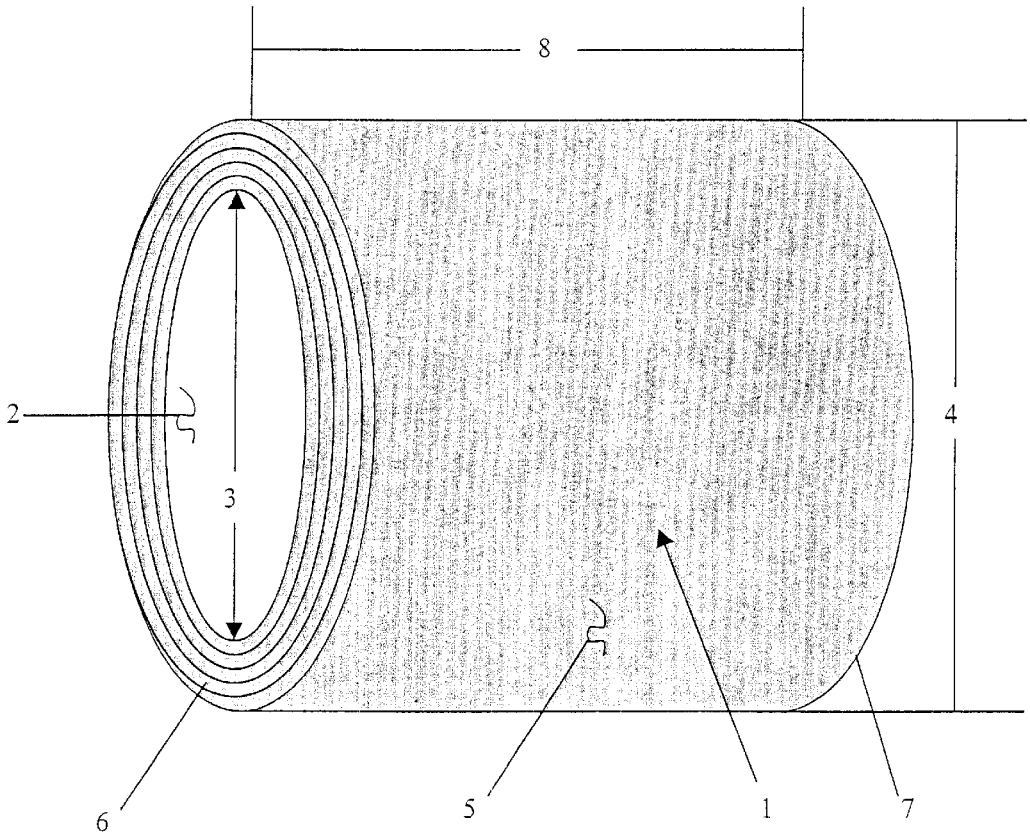
FIG. 1 is a perspective view of a metal coil that can be used with the present invention.

The apparatus for protecting and preventing corrosion on coiled metal of the present invention is generally used with a coil of metal. Any coiled metal may be used with the present invention. The only requirement is that the metal be rolled into a coil. Not wishing to be limited to any particular metal alloys, examples include steel, stainless steel and aluminum. Referring to FIG. 1, a metal coil 1 is characterized as having a cylindrical opening or "eye" with an eye diameter 3 and an inner surface 2. The metal coil 1 has a length 8, outer diameter 4, outer surface 5, first end 6 and second end 7.

Figure 2:
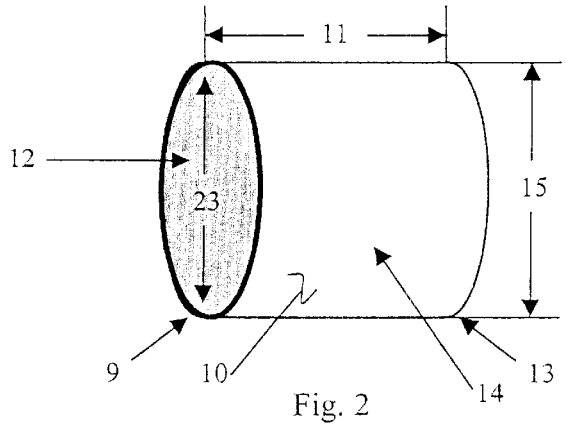
FIG. 2 is a perspective view of a core for an insert of the present invention.
Figure 3:
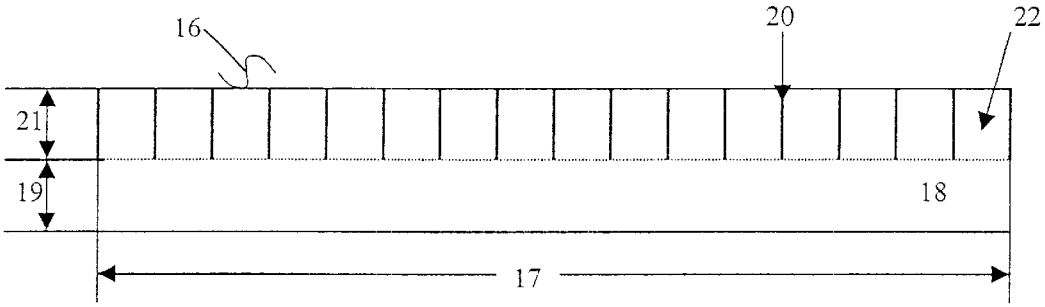
FIG. 3 is a front view of a wing for an insert of the present invention.
Figure 4:
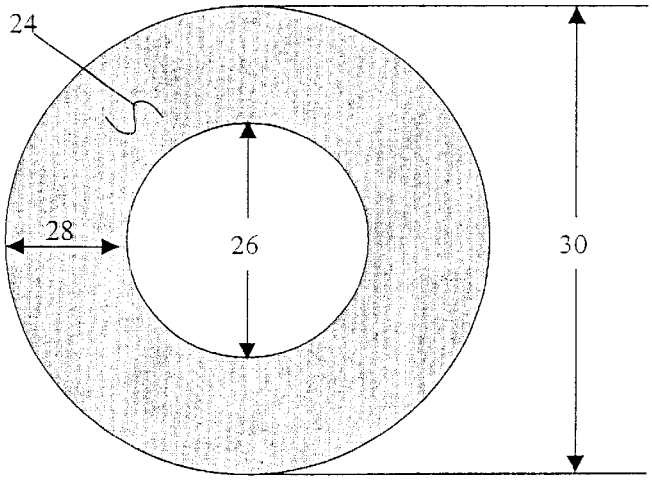
FIG. 4 is a front view of a detachable donut of the present invention.

The apparatus for protecting and preventing corrosion on coiled metal of the present invention includes an eye insert, which serves to seal and protect the eye of the metal coil 1. Referring to FIG. 2, the eye insert includes a core 10, which may be one piece or, alternatively, may include a first eye core side and a second eye core side. The core may be a cylinder or a sheet of material that is rolled into a cylindrical shape. When the two-piece core construction is used, each "half" of the eye core will include a core 10, a wing 16 and a detachable donut 24, as shown in FIGS. 2–4. The core 10 has an inner surface 12, an outer surface 14, a first end 9 and a second end 13. Core 10 may be cut longitudinally along its length. This provides a "spring-back" action which aids in its function of maintaining contact with the inner surface 2 of the eye of the metal coil 1. Core 10 has a length 11 and a diameter 23. The length 11 of core 10 will vary depending on whether a one-piece core or a two-piece core is used. When a one-piece core is used, length 11 will be approximately the same as the length 8 of the metal coil 1. Core 10 may be made from chipboard, plastic, cardboard, paper or linerboard. The thickness of core 10 can be about 0.02 to 0.5 inch, preferably 0.05 to 0.25 inch and most preferably 0.06 to 0.1 inch. Inner surface 12 of core 10 can be coated with a resin, dry wax or dispersion of wax, HDPE, paraffin, polybutene, polyethylene, polypropylene, carnauba/paraffin or carnauba/microcrystalline to prevent outside moisture from penetrating into the enclosure. Examples of such dispersions which may be used include those available from Michelman, Inc., Cincinnati, Ohio, including Wax Dispersion 40, Wax Dispersion 141, Michem® Dispersion 91530, Michem® Prime 4983R, Michem® Prime 4990R, Michem® Guard 20, Michem® Emulsion 02925, Michem® Emulsion 32535, Michem® Emulsion 34935, Michem® Emulsion 35160, Michem® Emulsion 37135, Michem® Emulsion 39235, Michem® Emulsion 41540, Michem® Emulsion 43040, Michem® Emulsion 44730, Michem® Emulsion 59740, Michem® Emulsion 61335, Michem® Emulsion 62330, Michem® Emulsion 66035, Michem® Emulsion 68725, Michem® Emulsion 93235, Michem® Emulsion 98040M1, Michem® Lube 126, Michem® Lube 135, Michem® Lube 180, Michem® Lube 182, Michem® Lube 188, Michem® Lube 190, Michem® Lube 270R, Michem® Lube 368, Michem® Lube 511, Michem® Lube 693, Michem® Lube 723, Michem® Lube 743, Michem® Shield 200, Michem® Tuff 200 and Michem®Wood 50. The resin, dry wax or dispersion may be applied to inner surface 12 of core 10 by laminating, rolling, brushing or spraying.

Outer surface 14 may be laminated with kraft paper, which may be coated with a vapor phase corrosion inhibitor (VPCI). Core 10 will have an outside diameter 15 approximately the same or slightly less than the eye diameter 3 of metal coil 1. A non-limiting example would be when metal coil 1 has a 24-inch eye diameter 3 and core 10 has an outside diameter 15 of 23.875 inches.

Referring to FIG. 3, wing 16 includes a collar 18 and a plurality of wing members 22 separated by notches 20. The thickness of wing 16 can be about 0.06 to 0.6 inch, preferably about 0.08 to 0.4 inch and most preferably about 0.1 to 0.25 inch. Wing 16 can be made from chipboard, linerboard, cardboard or paper. Preferably, wing 16 is made from chipboard or cardboard and is laminated with a white clay-coated paper. The length 17 of wing 16 will be approximately the same as the circumference of core 10, which is the inside radius 23 of core 10 times B (B×diameter=radius of a circle). The width 19 of collar 18 will be about 2 to 10 inches, preferably about 3 to 8 inches. The width 21 of wing members 22 will be about 2 to 20 inches, preferably about 2 to 10 inches and most preferably about 3 to 8 inches.

Referring to FIG. 4, detachable donut 24 has an inner diameter 26 approximately the same as eye diameter 3 of metal coil 1 being protected. Width 28 will be large enough to protect the metal coil from a C hook. Width 28 will be about 4 to 20 inches, preferably about 6 to 16 inches and most preferably about 8 to 14 inches. Outer diameter 30 will be the sum of inner diameter 26 and twice the width 28.

Figure 5:
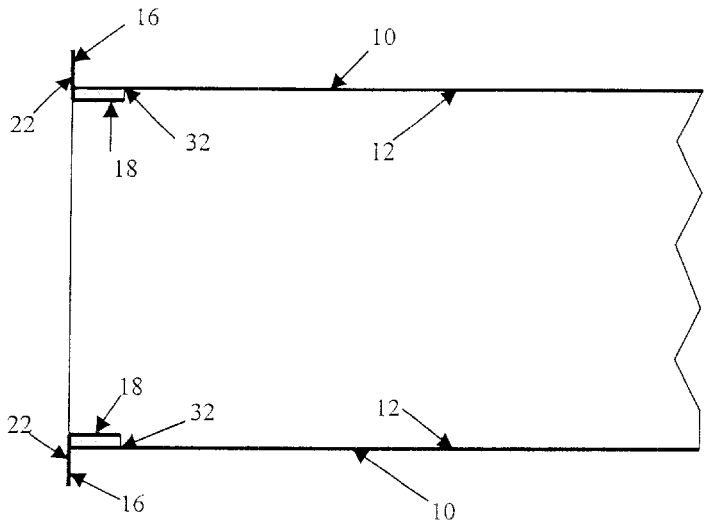
FIG. 5 is a partial cross-sectional view of one side of an insert of the present invention.

As shown in FIG. 5, wing 16 can be attached to inner surface 12 of core 10 by placing an adhesive 32 onto a side of collar 18 and placing collar 18 in contact with inner surface 12 of core 10. Any adhesive known in the art for bonding chipboard, plastic, cardboard, plastic or paper can be used. Examples of suitable adhesives include, but are not limited to, pressure sensitive adhesives, hot melt adhesives, aerosol adhesives, contact adhesives and double-sided tape.

Figure 6:
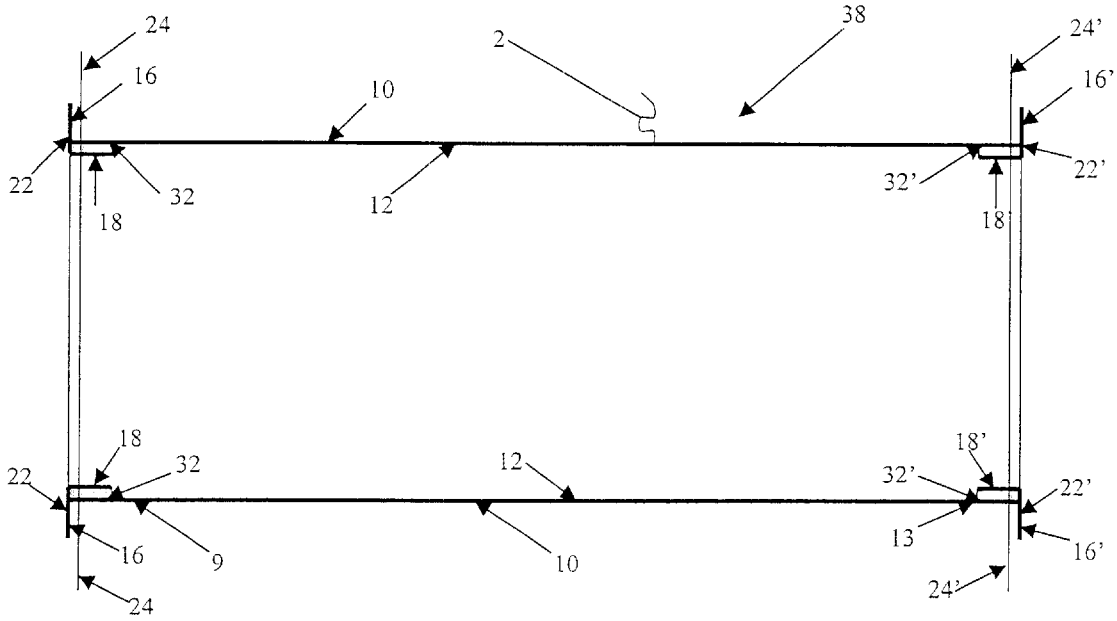
FIG. 6 is a cross-sectional view of an insert of the present invention.
Figure 8:
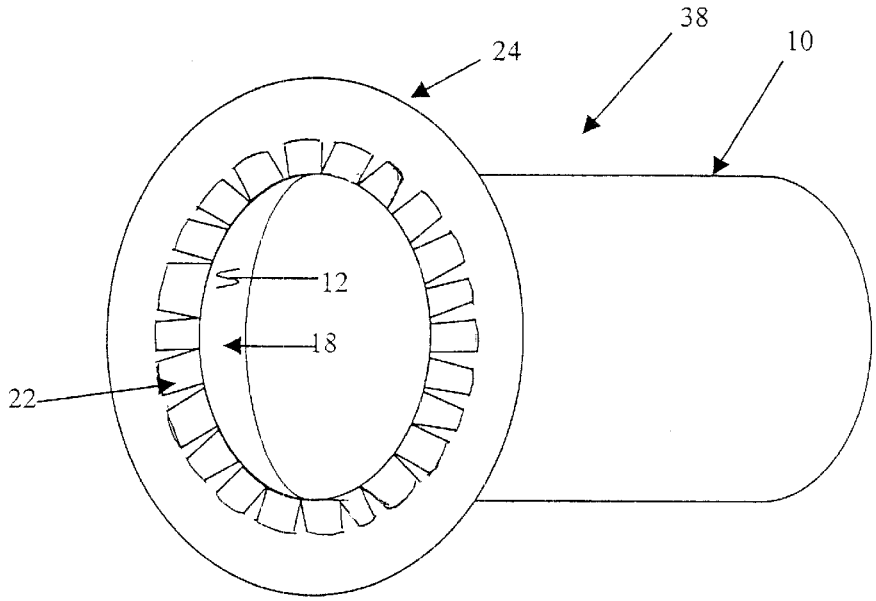
FIG. 8 is a partial perspective view of an insert of the present invention.

FIG. 6 shows a cross-sectional view and FIG. 8 shoes a partial perspective view of a completely assembled eye insert 38. Core 10 has a first detachable donut 24, which has an inner diameter 26 such that it can fit over the first end 9 of core 10, and a second detachable donut 24' having an inner diameter such that it can fit over the second end 13 of core 10. A first wing 16 has a collar 18 that fits within the first end 9 of core 10 and wing members 22 aligned next to first donut 24. A second wing 16' has a collar 18' that fits within the second end 13 of core 10 and a second wing member 22' next to second donut 24'.

Figure 7:
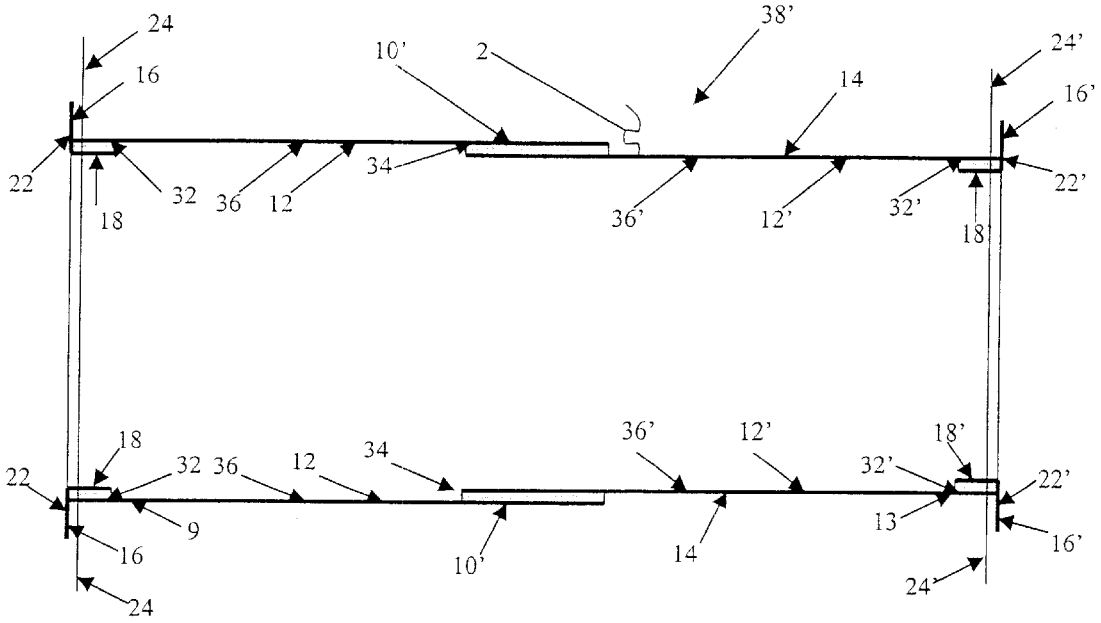
FIG. 7 is a cross-sectional view of an insert with the two piece core of the present invention.

FIG. 7 shows a cross-sectional view of an alternative completely assembled eye insert 38'. In alternative eye insert 38', core 10' has two sides, eye core side 36 and second eye core side 36'. The two eye core sides 36 and 36' are each passed through detachable donuts 24 and 24', respectively, and eye core side 36' is inserted into eye core 36. In order to improve the holding power of eye core side 36' to eye core side 36, an adhesive 34 is placed on an outer surface 14 of eye core 36' and/or on an inner surface 12 of eye core side 36 such that the adhesive forms a bond between outer surface 14 of eye core 36' and inner surface 12 of eye core side 36 along all surfaces in contact. Any adhesive known in the art for bonding chipboard, plastic, cardboard, plastic or paper can be used. Examples of suitable adhesives include, but are not limited to, pressure sensitive adhesives, hot melt adhesives, aerosol adhesives, contact adhesives and double-sided tape.

Figure 9:
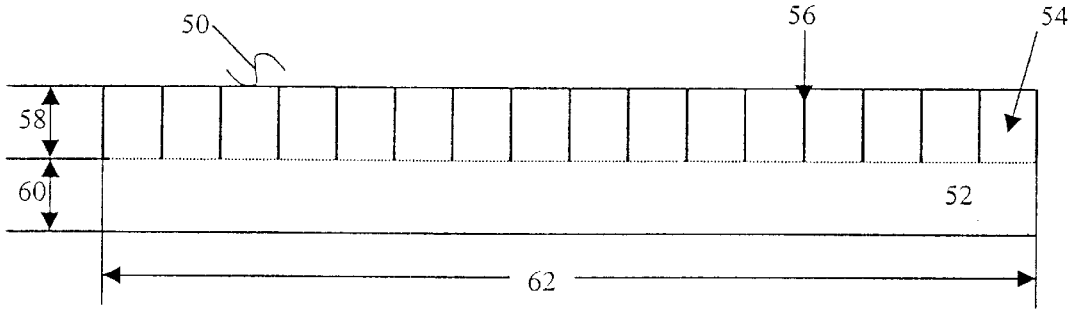
FIG. 9 is a front view of a rim protector of the present invention.

Referring to FIG. 9, rim protector 50 includes a rim 52 and a plurality of edges 54 separated by notches 56. The thickness of rim protector 50 can be about 0.06 to 0.6 inch, preferably about 0.08 to 0.4 inch and most preferably about 0.1 to 0.25 inch. Rim protector 50 can be made from chipboard, linerboard, cardboard or paper. Preferably, rim protector 50 is made from chipboard or cardboard. The length 62 of rim protector 50 will be approximately the same as the circumference of metal coil 1, which is the outer diameter 4 of metal coil 1 times B (B×diameter= circumference of a circle). The width 60 of rim 52 will be about 2 to 10 inches, preferably about 3 to 8 inches. The width 58 of edge 54 will be about 2 to 20 inches, preferably about 2 to 10 inches and most preferably about 3 to 8 inches.

In order to attach wing 16 or 16' to inner surface 12 or 12' of core 10 or core 10' and to form a bond between eye core sides 36 and 36' to form core 10', adhesives 32, 32' and 34 are used, respectively. Any adhesive known in the art for bonding chipboard, plastic, cardboard, or paper can be used. Examples of suitable adhesives include, but are not limited to, pressure sensitive adhesives, hot melt adhesives, aerosol adhesives, contact adhesives and double-sided tape. Examples of double-coated tape which are suitable for the present invention are disclosed in U.S. Pat. No. 4,418,105 to Stranton; U.S. Pat. No. 4,844,973 to Konishi et al.; U.S. Pat. No. 5,372,865 to Arakawa et al.; U.S. Pat. No. 5,466,500 to Pluim; and U.S. Pat. No. 5,599,602 to Leonard et al., herein incorporated by reference. Specific double-coated adhesive tapes that can be used in the present invention include TESA 4970 available from Veneer Systems, Inc., Buffalo, N.Y. and DC-1511 Polyolefin, DC-4513LB Polyolefin, DC-5225 Cotton Cloth, DC-5227X Exhibition Carpet Tape, DC-5235FR Flame Retardant, DC-4425LB White PVC and DC-4425CS Clear PVC available from Adhesive Tape Products, Miami, Fla.

When the adhesive is a contact or pressure sensitive adhesive, any of such adhesives known in the art may be used. Specific examples include, but are not limited to, cyanoacrylate adhesives such as those described in U.S. Pat. No. 4,560,723 to Millet et al. Suitable cyanoacrylate adhesives include the 3M CA series of cyanoacrylate adhesives available from the 3M Company, St. Paul, Minn. Hot Melt adhesives may be used as part of the present invention. Specific examples include, but are not limited to, hot melt adhesives such as 3M 37552M, 3M 3762LM, 3M 3778LM, 3M 3738, 3M 3747, 3M 3762 and 3M 3796 available from the 3M Company. A contact adhesive such as the Fastbond Contact Adhesive from the 3M Company can also be used.

Figure 10:
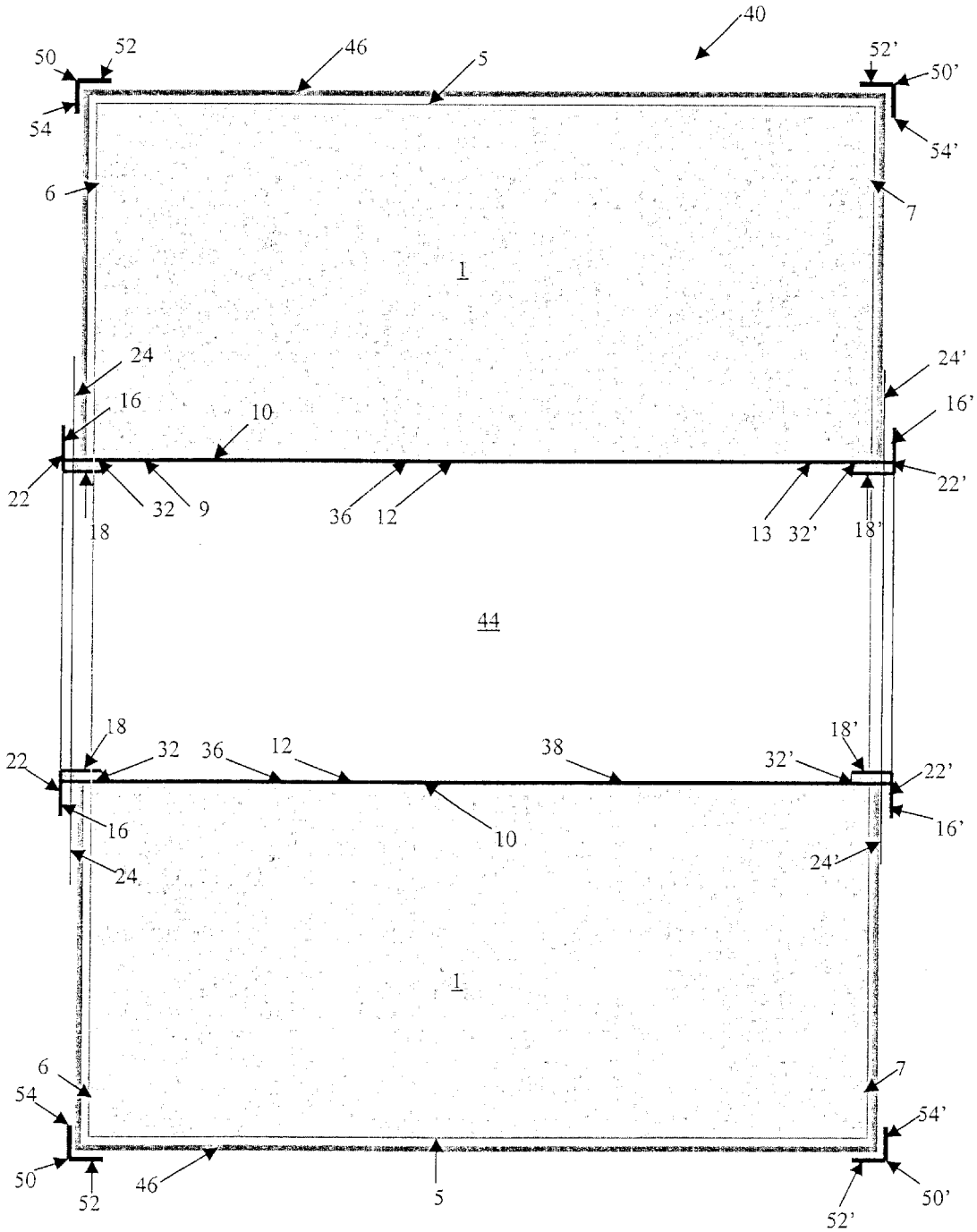
FIG. 10 is a cross-sectional view of a protected metal coil of the present invention.

FIG. 10 shows a cross-sectional view of a protected metal coil 40, which includes a metal coil 1 surrounded and enclosed (except inside an eye area 44) by a VPCI impregnated material 46 and an eye insert 38. Eye insert 38 includes core 10, first detachable donut 24, second detachable donut 24', first wing 16, including collar 18 and wing members 22, second wing 16', including collar 18' and second wing members 22'. Optionally, adhesives 32 and 32' hold collar 18 of first wing 16 and second collar 18' of second wing 16' in place.

Metal coil 1 is protected by the following method. VPCI impregnated material 46 is wrapped around metal coil 1 such that metal coil 1 is completely encased by VPCI impregnated material 46. The VPCI impregnated material 46 may be cut in the area surrounding eye area 44 in order to facilitate folding any VPCI impregnated material 46 that extends into eye area 44 along inner surface 2 of metal coil 1. Core 10 is placed within eye area 44. Detachable donut 24 and second detachable donut 24' are placed onto first end 9 and second end 13 of core 10, respectively. Collar 18 of wing 16 is placed along inner surface 12 at first end 9 of core 10 and second collar 18' of second wing 16' is placed along inner surface 12 at second end 13 of core 10. Alternatively, adhesives 32 and 32' may be used to secure collar 18 of first wing 16 to inner surface 12 at first end 9 of core 10 and second collar 18' of second wing 16' to inner surface 12 at second end 13 of core 10, respectively. Wing members 22 and 22' fit snugly against detachable donut 24 and second detachable donut 24', respectively. Detachable donut 24 and second detachable donut 24' fit snugly against VPCI impregnated material 46.

Rim Protectors 50 and 50' are used to protect VPCI impregnated material 46 at the edges formed by outer surface 5 and first end 6 and second end 7 of metal coil 1. Rim 52 is placed on top of the VPCI impregnated material at outer surface 5 and first end 6 of protected metal coil 40. Edge 54 is folded over and is placed against VPCI impregnated material 46 along first end 6. Rim 52' is placed on top of the VPCI impregnated material at outer surface 5 and second end 7 of protected metal coil 40. Edge 54' is folded over and is placed against VPCI impregnated material 46 along second end 7.

An alternative method for protecting metal coil 1 utilizes a two-piece core. VPCI impregnated material 46 is wrapped around metal coil 1 such that metal coil 1 is completely encased by VPCI impregnated material 46. The VPCI impregnated material 46 may be cut in the area surrounding eye area 44 in order to facilitate folding any VPCI impregnated material 46 that extends into eye area 44 along inner surface 2 of metal coil 1. Eye core side 36 is placed within eye area 44 at first end 6. Second eye core side 36' is placed within eye area 44 at second end 7 such that second eye core side 36' is inserted into eye core 36. An adhesive 34 may be placed on an outer surface 14 of second eye core 36' and/or on an inner surface 12 of eye core side 36 such that the adhesive forms a bond between outer surface 14 of eye core 36' and inner surface 12 of eye core side 36 along all surfaces in contact. Eye core side 36 and second eye core side 36' thus form core 10'. Detachable donut 24 and second detachable donut 24' are placed onto first end 9 and second end 13 of core 10', respectively. Collar 18 of first wing 16 is placed along inner surface 12 at first end 9 of core 10' and second collar 18' of second wing 16' is placed along inner surface 12 at second end 13 of core 10'. Alternatively, adhesives 32 and 32' may be used to secure collar 18 of first wing 16 to inner surface 12 at first end 9 of core 10' and second collar 18' of second wing 16' to inner surface 12 at second end 13 of core 10', respectively. Wing members 22 and 22' fit snugly against detachable donut 24 and second detachable donut 24', respectfully. Detachable donut 24 and second detachable donut 24' fit snugly against VPCI impregnated material 46.

The VPCI impregnated material 46 will have a base material which can be paper, metal, plastic, or other resinous material. The base material can consist of a single layer or a plurality of layers of the same material or a combination of materials. The base material is impregnated with a VPCI material. Suitable VPCI materials include amine benzoates such as cyclohexylamine benzoate and ethylamine benzoate, sodium nitrates, amine nitrates such as dicyclohexylamine nitrate, aromatic triazoles such as benzotriazole and tolyltriazole, and anhydrous molybdates such as sodium molybdate, ammonium molybdate and amine molybdates. A mixture of VPCI materials can be used and such a mixture of VPCI materials is preferred. The VPCI can be coated onto paper or extruded into a plastic or resinous film. The VPCI is present in the base material at from about 0.1 to 10 wt. %, preferably from about 0.25 to 8.0 wt. %, and most preferably from about 0.5 to 5.0 wt. %. When the VPCI material is present at less than about 0.1 wt. %, insufficient corrosion protection may be provided. When the VPCI material is present at greater than about 10 wt. %, the integrity of the base material may be degraded and an excess of VPCI material may be deposited on the surface of the metal coil leading to undesirable surface properties. In a preferred embodiment, the VPCI impregnated material is an extruded polyethylene film containing about 1–3 wt. % of a mixture of about 70 wt. % anhydrous sodium molybdate, about 25 wt. % sodium nitrate and about 5 wt. % benzotriazole.

Examples of VPCI impregnated materials that can be used in the present invention are those supplied by CORTEC Corporation under the trade names CI-121 Barrier Film, VCI-126 Multimetal LDPE Heat Sealable Film, VCI-125/128 Static Dissipative and Static Shielding Film, VCI-129 HDPE Film, VCI-144 Paper, VCI-Multimetal Inhibitor Paper, VCI-148 Grease resistant Paper, Eco Weave® VCI Woven Polyethylene, Cor-Pak™ VCI Bubbles, Cor Pak™ Cold Seal, Cor Pak™ VCI Corrugated PE Sheeting, Cor Pak™ Film and Cor Pak™ Stretch Film.

Figure 11:
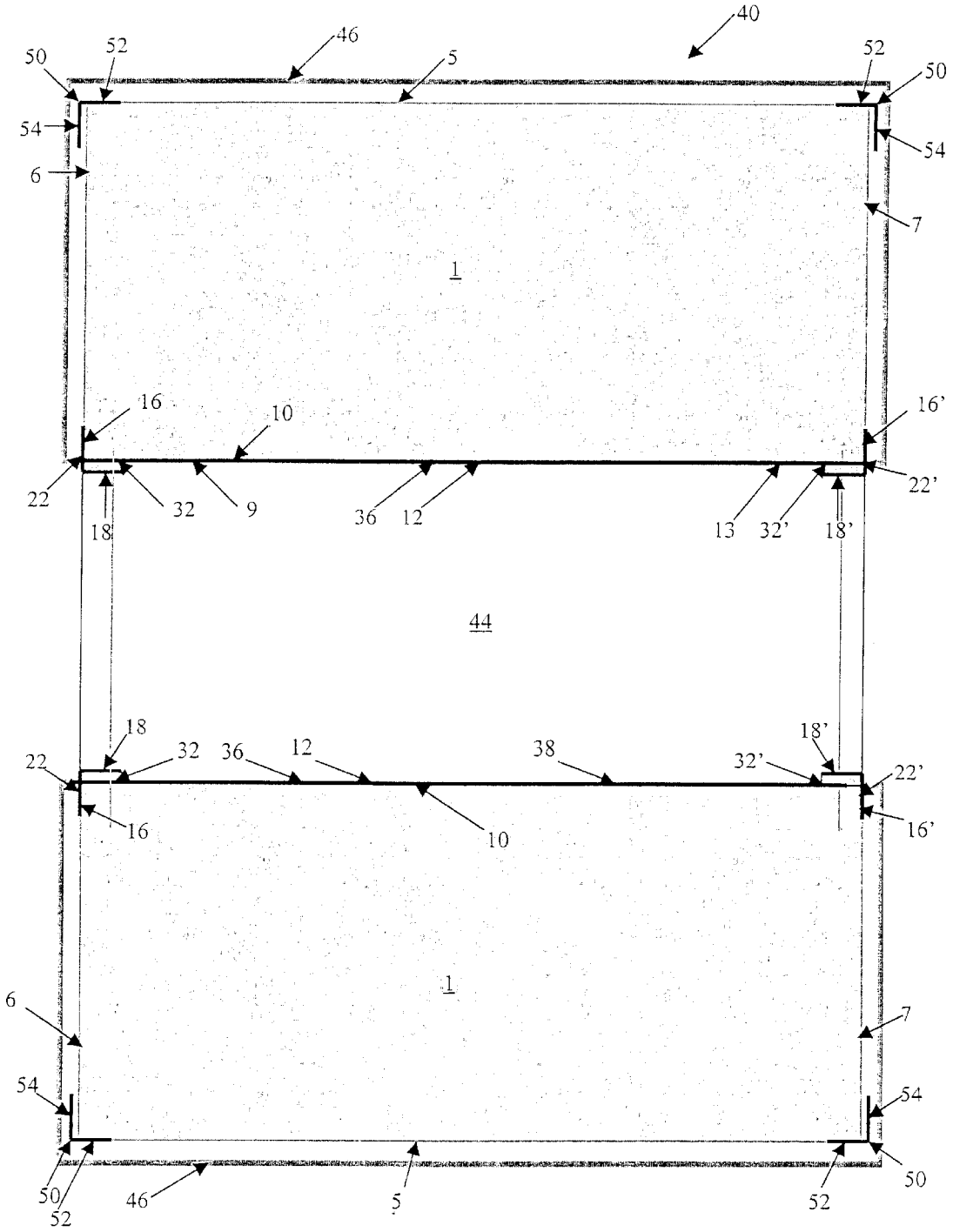
FIG. 11 is a cross-sectional view of a protected metal coil of the present invention.

FIG. 11 shows a cross-sectional view of a protected metal coil 40', which includes a metal coil 1 surrounded and enclosed (except inside an eye area 44) by a VPCI impregnated material 46 and an eye insert 38. In this embodiment, VPCI material 46 is the outermost layer of protected metal coil 40'. Eye insert 38 includes core 10, first detachable donut 24, second detachable donut 24', first wing 16, including collar 18 and wing members 22, second wing 16', including collar 18' and second wing member 22'. Optionally, adhesives 32 and 32' hold collar 18 of first wing 16 and second collar 18' of second wing 16' in place.

Metal coil 1 is protected by the following method. Core 10 is placed within eye area 44. Collar 18 of wing 16 is placed along inner surface 12 at first end 9 of core 10 and second collar 18' of second wing 16' is placed along inner surface 12 at second end 13 of core 10. Alternatively, adhesives 32 and 32' may be used to secure collar 18 of first wing 16 to inner surface 12 at first end 9 of core 10 and second collar 18' of second wing 16' to inner surface 12 at second end 13 of core 10, respectively. Wing members 22 and 22' fit snugly against metal coil 1.

Rim Protectors 50 and 50' are used to protect VPCI impregnated material 46 at the edges formed by outer surface 5 and first end 6 and second end 7 of metal coil 1. Rim 52 is placed on top of metal coil 1 at outer surface 5 and first end 6. Edge 54 is folded over and placed on metal coil 1 along first end 6. Rim 52' is placed on top of metal coil 1 at outer surface 5 and second end 7. Edge 54' is folded over and placed against metal coil 1 along second end 7.

VPCI impregnated material 46 is wrapped around metal coil 1, rim protectors 50 and 50' and wing members 22 and 22' such that metal coil 1 is completely encased by VPCI impregnated material 46.

Alternating layers may be used as part of the apparatus for protecting and preventing corrosion on coiled metal of the present invention. For example, metal coil 1 may be protected as described in conjunction with FIG. 10, followed by a second application of VPCI impregnated material 46, resulting in the enclosure of rim protectors 50 and 50' and wing members 22 and 22'. No limitation is placed on the layering of VPCI impregnated material 46.

VPCI material 46 can be applied to metal coil 1 manually by wrapping a continuous sheet around metal coil 1. A machine can also be used where metal coil 1 rests on rollers in an eye horizontal position causing metal coil 1 to take on a rolling motion. While metal coil 1 moves in the rolling motion, a swing arm rotates around metal coil 1 applying a continuous sheet of VPCI impregnated material 46. The rolling motion and swing arm application continue for a complete revolution of metal coil 1 to completely encase outer surface 5 and ends 6 and 7 with VPCI impregnated material 46. Alternatively, and preferably, this step is repeated to add additional layers of VPCI impregnated material 46. Any number of layers of VPCI impregnated material 46 may be applied as part of the present invention, which may include 1 to 20, preferably 2 to 15 and more preferably 3 to 10 layers of VPCI impregnated material 46.

In a preferred embodiment, the rolling action and swing arm application as described above are used to apply 3 to 5 layers of VPCI impregnated material such that the swing arm rotates around the rolling metal coil in an area above the center of eye area 44. Assembled eye insert 38 or 38' is then applied as described above and rim protectors 50 and 50' are applied as described above. An additional 3 to 5 layers of VPCI impregnated material are then applied such that the swing arm rotates around the rolling metal coil in an area above the center of eye area 44.

The invention has been described with reference to the preferred embodiment. Obvious modifications and alterations will occur to others upon reading and understanding the preceding description. It is intended that the invention be construed as including all such modifications and alterations insofar as they come within the scope of appended claims or the equivalents thereof.

I claim:

1. An apparatus for protecting coiled metal comprising a metal coil having an eye at its center; a vapor phase corrosion inhibitor (VPCI) impregnated material which completely encloses the outer surface of the metal coil; a core which extends along the length of the eye, having a first end and a second end; a first wing having a collar that fits within said first end of said core and wing members aligned next to said VPCI impregnated material; and a second wing having a collar that fits within said second end of said core and wing members aligned next to said VPCI material.

2. The apparatus for protecting coiled metal of claim 1 further comprising a first detachable donut having an inner diameter such that it can fit over the first end of said insert and a second detachable donut having an inner diameter such that it can fit over the second end of said insert, said first detachable donut and said second detachable donut being held in place by wing members of said first wing and said second wing, respectively.

3. The apparatus for protecting coiled metal of claim 1 wherein said core comprises a first eye core side and a second eye core side that combine to form said core.

4. The apparatus for protecting coiled metal of claim 3 wherein a first end of said second eye core side fits inside of a second end of said first eye core side.

5. The apparatus for protecting coiled metal of claim 1 wherein an outer surface of said core is laminated with kraft paper which is coated with a vapor phase corrosion inhibitor.

6. The apparatus for protecting coiled metal of claim 1 wherein an inner surface of said core is coated with one or more materials selected from the group consisting of a resin, dry wax, wax dispersion, HDPE, polybutene, polyethylene, polypropylene, carnauba and paraffin.

7. The apparatus for protecting coiled metal of claim 1 wherein said core is made from one or more materials selected from the group consisting of chipboard, plastic, cardboard, paper and linerboard.

8. The apparatus for protecting coiled metal of claim 1 wherein multiple layers of the VPCI impregnated material are used.

9. The apparatus for protecting coiled metal of claim 8 wherein the number of layers of the VPCI impregnated material is from 1 to 20.

10. The apparatus for protecting coiled metal of claim 1 wherein the VPCI used to impregnate the VPCI impregnated material is one or more selected from the group consisting of amine benzoates, sodium nitrates, amine nitrates, aromatic triazoles, and anhydrous molybdates.

11. The apparatus for protecting coiled metal of claim 1 wherein the collar of the first wing that fits within the first end of said core and the collar of the second wing that fits within the second end of said core are held in place using a material selected from double-sided tape and an adhesive.

12. The apparatus for protecting coiled metal of claim 1 wherein the material which is impregnated with VPCI (VPCI impregnated material) is one or more selected from the group consisting of paper, metal and plastic.

13. The apparatus for protecting coiled metal of claim 12 wherein the VPCI impregnated material is an extruded polyethylene film and the VPCI material comprises sodium molybdate, sodium nitrate and benzotriazole.

14. The apparatus for protecting coiled metal of claim 1 wherein the first detachable donut, second detachable donut, first wing and second wing are comprised of one or more materials selected from the group consisting of paper, metal, chipboard, plastic, cardboard, and linerboard.

15. The apparatus for protecting coiled metal of claim 1 wherein the metal coil is comprised of a metal selected from the group consisting of steel, stainless steel and aluminum.

16. The apparatus for protecting coiled metal of claim 1 further comprising a first rim protector and a second rim protector, wherein a rim of the first rim protector is placed on top of the VPCI impregnated material at an outer surface and a first end of the metal coil and an edge of the first rim protector is folded over and placed against the VPCI impregnated material along the first end of the metal coil, and a rim of the second rim protector is placed on top of the VPCI impregnated material at an outer surface and a second end of the metal coil and an edge of the second rim protector is folded over and placed against the VPCI impregnated material along the second end of the metal coil.

17. The apparatus for protecting coiled metal of claim 16 wherein 3 to 5 layers of the VPCI impregnated material comprise a first layer, which is next to the metal coil, the first wing, second wing, first rim protector and second rim protector are next to the first layer, and a second layer comprising 3 to 5 layers of the VPCI impregnated material encloses the metal coil, the first wing, second wing, first rim protector and second rim protector.

18. A method for protecting a metal coil, which has an eye, an inner surface, a first side, a second side and an outer surface, comprising the steps of:

wrapping the metal coil with a vapor phase corrosion inhibitor (VPCI) impregnated material such that the outer surface, first side and second side of the metal coil are encased by the VPCI impregnated material;

inserting a core, having a first end, a second end, an inner surface and an outer surface, into the eye;

placing a collar of a first wing within the first end and against the inner surface of the core and wing members of the first wing against the VPCI impregnated material;

placing a collar of a second wing within the second end and against the inner surface of the core and wing members of the second wing against the VPCI impregnated material.

19. The method of claim 18 further comprising the steps of:

placing a first detachable donut, having an inner diameter, against the VPCI impregnated material encasing the first side of the metal coil such that the inner diameter of the first detachable donut fits over the first end of the core; and placing a second detachable donut, having an inner diameter, against the VPCI impregnated material encasing the second side of the metal coil such that the inner diameter of the second detachable donut fits over the second end of the core.

20. The method of claim 18 further comprising the steps of:

placing a rim of a first rim protector on top of the VPCI impregnated material at an outer surface and a first end of the metal coil;

folding an edge of the first rim protector and placing it against the VPCI impregnated material along the first end of the metal coil;

placing a rim of a second rim protector on top of the VPCI impregnated material at an outer surface and a second end of the metal coil; and folding an edge of the second rim protector and placing it against the VPCI impregnated material along the second end of the metal coil.

21. The method for protecting a metal coil of claim 18 wherein the core comprises a first eye core side having a first end, a second end, an inner surface and an outer surface; and a second eye core side having a first end, a second end, an inner surface and an outer surface, wherein the step of inserting the core is comprised of:

inserting the first eye core side into the first side of the eye;

inserting the first end of said second eye core side inside of the second side of the eye, such that the outer surface of the second eye core side rests against the inner surface of the first eye core side.

22. The method for protecting a metal coil of claim 21 wherein an adhesive layer is placed between the outer surface of the second insert and the inner surface of the first insert.

23. The method for protecting a metal coil of claim 18 wherein an adhesive layer is placed between the first portion of the first wing and the inner side of the insert and between the first portion of the second wing and the inner side of the insert.

24. The method for protecting a metal coil of claim 18 further comprising the steps of:

placing the metal coil in an eye horizontal position on rollers;

putting the metal coil into a rolling motion with the rollers; and applying a continuous sheet of VPCI impregnated material with a mechanical swing arm which rotates around the rolling metal coil.

25. A method for protecting a metal coil which has an eye, an inner surface, a first side, a second side and an outer surface, comprising the steps of:

placing the metal coil in an eye horizontal position on rollers;

putting the metal coil into a rolling motion with the rollers;

applying a continuous sheet of a VPCI impregnated material with a mechanical swing arm which rotates around the rolling metal coil such that from 3 to 5 layers of the VPCI impregnated material are applied to the metal coil;

inserting a core having a first end, a second end, an inner surface and an outer surface into the eye by:

inserting a first eye core side into the first side of the eye; and inserting a first end of a second eye core side inside of the second side of the eye, such that the outer surface of the second eye core side rests against the inner surface of the first eye core side;

placing a collar of a first wing within the first end and against the inner surface of the core and wing members of the first wing against the VPCI impregnated material;

placing a collar of a second wing within the second end and against the inner surface of the core and wing members of the second wing against the VPCI impregnated material;

placing a rim of a first rim protector on top of the VPCI impregnated material at an outer surface and a first end of the metal coil;

folding an edge of the first rim protector and placing it against the VPCI impregnated material along the first end of metal coil;

placing a rim of a second rim protector on top of the VPCI impregnated material at an outer surface and a second end of the metal coil;

folding an edge of the second rim protector and placing it against the VPCI impregnated material along the second end of metal coil; and applying a second continuous sheet of the VPCI impregnated material by rotating the mechanical swing arm around the rolling metal coil such that from 3 to 5 layers of the VPCI impregnated material are applied to the metal coil such that the layers of the VPCI impregnated material encase the metal coil, the first wing, second wing, first rim protector and second rim protector.

* * * * *